US005993267A

United States Patent [19]

Lin

[11] Patent Number: 5,993,267

[45] Date of Patent: Nov. 30, 1999

[54] TERMINAL BLOCK

[76] Inventor: Y. S. Lin, P.O. Box 63-150, Taichung, Taiwan

[21] Appl. No.: 09/039,406

[22] Filed: Mar. 16, 1998

[51] Int. Cl.[6] ..... H01R 9/22

[52] U.S. Cl. ..... 439/709

[58] Field of Search ..... 439/709–712, 439/715–719, 723–729, 491

[56] References Cited

U.S. PATENT DOCUMENTS

| | | | |
|---|---|---|---|
| 5,376,024 | 12/1994 | Sako et al. | 439/813 |
| 5,411,417 | 5/1995 | Horn et al. | 439/709 |
| 5,704,815 | 1/1998 | Shibata et al. | 439/709 |

*Primary Examiner*—Khiem Nguyen

[57] ABSTRACT

An improved terminal block comprises a plastic injection-molded body including a rear surface as a stopper surface; a front surface; two spaced longitudinal parallel spaces at the front surface; two inverted-U-shaped notches at the front surface on left and right sides of the body for easily positioning an electrically conductive wire thereon; a shielding portion extending transversely above the spaces and having through holes in registration with the spaces, respectively, and slanted left and right corners each provided with an insert-receiving groove for receiving a predetermined length of an insert for identification purpose; two nut-receiving grooves parallel to each other and each extending vertically beneath one of the spaces; a narrowed recess extending vertically beneath each nut-receiving groove, each nut-receiving groove being able to slidably engage two opposite sides of a hexagon nut with a line passing along two diametrically opposite corners of the nut being parallel to the center line of the nut-receiving groove; the inverted-U-shaped notches receiving an L-shaped electrically conductive member in a horizontal position, the conductive member having a top portion and a stopper wall extending from and perpendicular to the top portion, the top portion having through holes corresponding to the two hexagon nuts, respectively; two clamping members disposed on the top portion of the conductive member and having threaded through hole; and two fixing screws each having a head of a diameter smaller than that of the through hole of the shielding portion such that the fixing screw may be threaded through the clamping member, the conductive member and the hexagon nut. The terminal block product can be prevented from losing its components during shipment, and may provide quick, easy and safe operation of interconnecting wires when in use.

4 Claims, 6 Drawing Sheets

TERMINAL BLOCK

FIELD OF THE INVENTION

This invention relates to electrical wire interconnecting device and more specifically to improvements on electrical wire terminal block.

BACKGROUND OF THE INVENTION

Terminal blocks are widely used in electrical wire layout operation in automatic control for interconnecting different electrically conductive wires. A prior art terminal block, commercially available in Europe for many years, is shown in FIGS. 1–4, comprises a block-shaped body 1, two fixing screws 2, an elongate pressing bar 3, and two vertically movable clamping members 4. The clamping member 4 is integrally stamped and formed from a T-shaped thin metal strip. The clamping member comprises a top portion having a threaded hole 4A, two lateral sides (4B, 4C) bent downwardly and overlapped at the bottom of the clamping member, and two tabs 4D transversely overlying the overlapped portion of the two sides (4B, 4C) and bent downwardly, perpendicular to the two sides, defining a space 4E allowing the pressing bar 3 to extend therethrough.

The body 1 has at the front surface two longitudinally parallel spacing ribs 1A each defining therein a space 1B allowing the clamping member 4 to move vertically along therein (FIG. 3). A notch 1C is formed at the middle section of the rib 1A at same horizontal position, allowing the pressing bar 3 to pass through. A seat 1D is disposed above each space 1B and has through hole 1E extending through the inner bottom of the seat. The hole 1E is dimensioned to allow the threaded shank 2A of the fixing screw 2 to pass through but stop the enlarged head 2B of the fixing screw 2. The fixing screw 2 may be threaded through the threaded hole 4A (FIG. 2).

The body 1 further has on the left and right sides two guiding apertures 1F, respectively, communicating with the spaces 1B and allowing two electrically conductive wires 5 to insert from the aperture 1F into the clamping member 1B. As shown in FIG. 2, the pressing bar 3 and the two clamping member 4 each may freely move along the space 1B and the notch 1C at one direction and, therefore, before the finished assembled terminal blocks leave where they are manufactured, the two fixing screws 2 need be tightly threaded into the threaded hole 4A of the clamping member 4 to prevent components from loosening and escaping during shipment. In this case, the aperture 1F from which the conductive wire enters into the guiding aperture 1F is blocked by the tab 4D of the clamping member 4, as shown in FIG. 2. It should be noted that when in use, the conductive wire 5 is inserted from the guiding aperture 1F to be in between the pressing bar 3 and the inner bottom of the space 4E of the clamping member 4 and clamped therebetween. Accordingly, to use such a terminal block for wire interconnecting, a user must firstly loosen the fixing screws 2 with a screw driver 6, as seen from FIG. 3, to lower the clamping members 4, insert the wires 5 from the guiding apertures 1F in between the pressing bar 3 and the inner bottm of the space 4E of the clamping members 4, and finally tighten the fixing screws 2 to raise the clamping member 4 so as to firmly holding the wires 6 between the pressing bar and the clamping member.

As can be seen from the above, the user needs to firstly loosen the fixing screws 2 and then tighten them. This is a tedious and time-expending work. Furthermore, the conductive wire 5 is intended to be clamped between the pressing bar 3 and the overlapped sides (4B, 4C) of the clamping member 4, however, as shown in FIG. 4, the overlapped sides (4B, 4C) may not maintain its original shape and is forced to open outwardly, although when the fixing screws are driven by a power-operated or a pneumatic screw driver that often impart excessive axial force to the fixing screws. It is understood that the ribs 1A formed of weak plastic structure cannot resist the force that causes the clamping member 4 to deform. Therefore, the conductive wire 5 may no longer be properly positioned due to the lack of sufficient compression force applied thereon, and pulled off from the terminal block, which causes the risk of short of circuit. Besides, the components of the above described terminal block are expensive to manufacture, particularly the pressing bar 3 which needs conductivity and rigidity sufficient to sustain compression force and thus require material of a greater thickness. The formation work of the clamping member 4 and the tapping work thereon also increases the production cost.

SUMMARY OF THE INVENTION

It is an object of the invention to provide an improved terminal block that prevents the components therein from falling off during shipment of the finished terminal block product.

Another object of the invention is to provide a terminal block that enables easy and simplified wire interconnecting operation.

A further object of the invention is to provide a terminal block that is effective and efficient to manufacture and the conductive wires can be firmly terminated thereon.

The objects of the invention have been accomplished by providing an improved terminal block comprising a plastic injection-molded body including a rear surface as a stopper surface; a front surface; two spaced longitudinal parallel spaces at the front surface; two inverted-U-shaped notches at the front surface on left and right sides of the body for easily positioning an electrically conductive wire thereon; a shielding portion extending transversely above the spaces and having through holes in registration with the spaces, respectively, and slanted left and right corners each provided with an insert-receiving groove for receiving a predetermined length of an insert for identification purpose; two nut-receiving grooves parallel to each other and each extending vertically beneath one of the spaces; a narrowed recess extending vertically beneath each nut-receiving groove, each nut-receiving groove being able to slidably engage two opposite sides of a hexagon nut with a line passing along two diametrically opposite corners of the nut being parallel to the center line of the nut-receiving groove; the inverted-U-shaped notches receiving an L-shaped electrically conductive member in a horizontal position, the conductive member having a top portion and a stopper wall extending from and perpendicular to the top portion, the top portion having through holes corresponding to the two hexagon nuts, respectively; two clamping members disposed on the top portion of the conductive member and having threaded through hole; two fixing screws each having a head of a diameter smaller than that of the through hole of the shielding portion such that the fixing screw may be threaded through the clamping member, the conductive member and the hexagon nut; whereby the terminal block product can be prevented from losing its components during shipment, and may provide quick, easy and safe operation of interconnecting wires when in use.

The preferred embodiment of this invention will now be described in more detail by way of reference to the figures, wherein.

DETAILED DESCRIPTION

Figure 5:
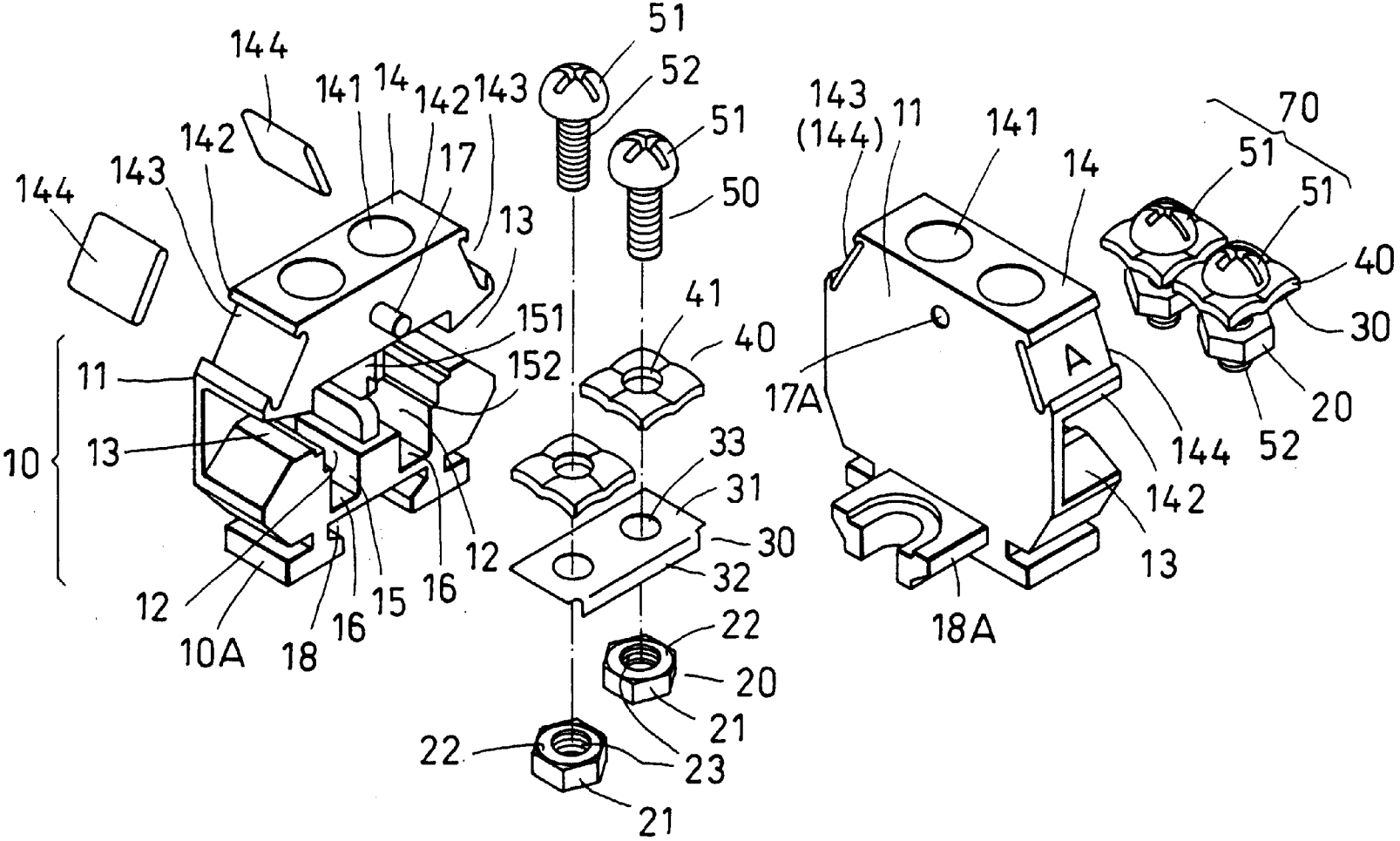
FIG. 5 is an exploded view of a terminal block of the present invention.

With reference first to FIG. 5, an improved terminal block according to the present invention is shown and comprises a plastic injection-molded body 10, two hexagon nuts 20, an L-shaped electrically conductive member 30, two clamping members 40 and two fixing screws 50.

The body 10 is of plate-like shape and includes a rear surface 11 as a stopper surface, two spaced longitudinal parallel spaces 12 at front surface, two inverted-U-shaped notches 13 at the front surface on left and right sides of the body 10 for allowing an electrically conductive wire 60 to extend therethrough, respectively. The body 10 further includes an integrally formed shielding portion 14 extending transversely above the spaces 12 and having through holes 141 in registration with the spaces 12, respectively. Each hole 141 allows a fixing screw 50 to freely fully extend therethrough as will be further dicussed later. The shielding portion 14 has slanted left and right corners 142 each having an insert-receiving groove 143 for receiving a predetermined length of an insert 144 which may be marked with desired symbol or code for identification purpose to facilitate wire interconnecting operation.

Figure 1:
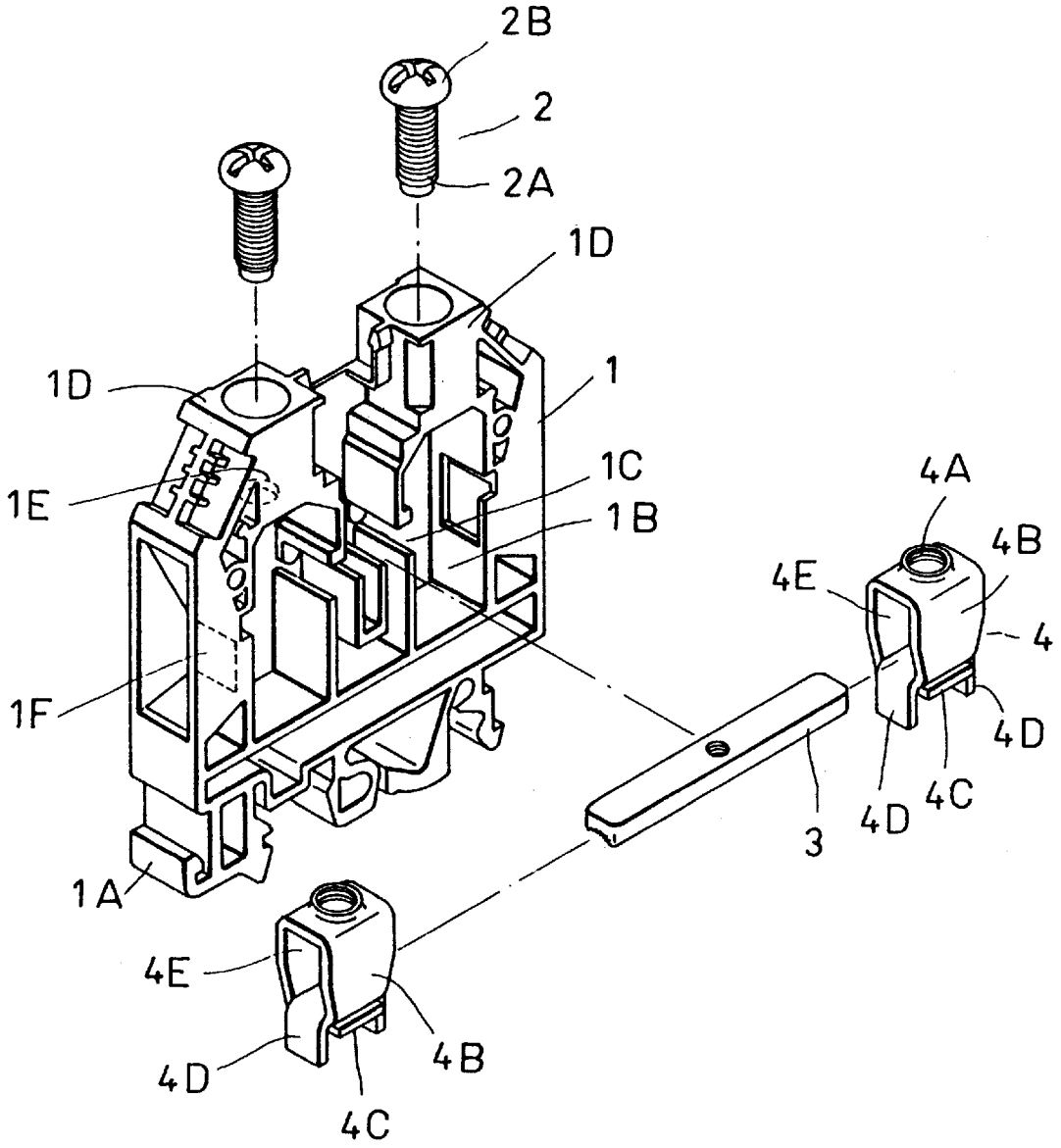
FIG.1 PRIOR ART
FIG. 1 is an exploded perspective view of a prior art terminal block.
Figure 2:
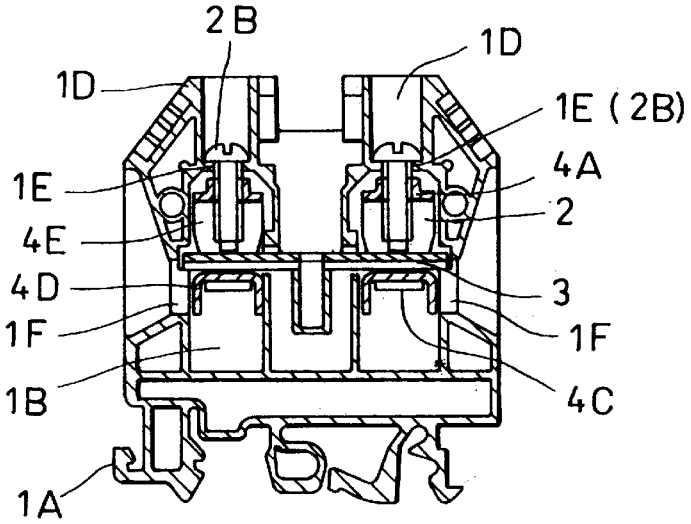
FIG. 2 PRIOR ART
FIG. 2 is a cross sectional view of the terminal block of FIG. 1 in assembled mode.
Figure 3:
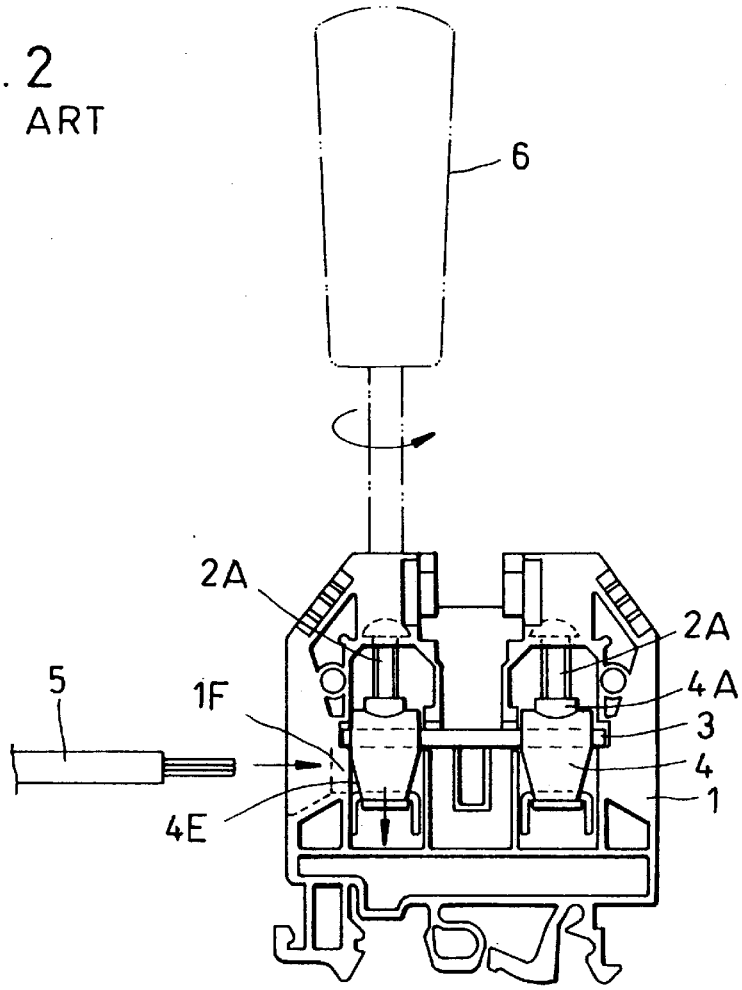
FIG. 3 PRIOR ART
FIG. 3 is a cross sectional view of the terminal block of FIG. 1 about to receive a conductive wire.
Figure 4:
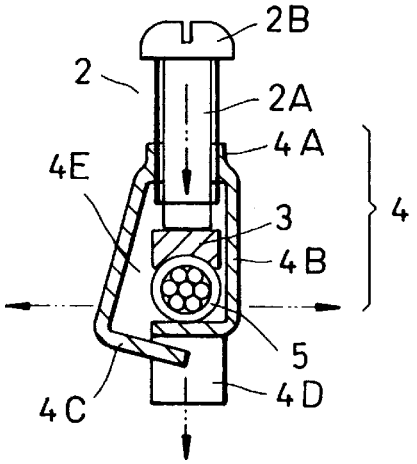
FIG. 4 PRIOR ART
FIG. 4 is a cross sectional view of a clamping member of the terminal block of FIG. 1.
Figure 6:
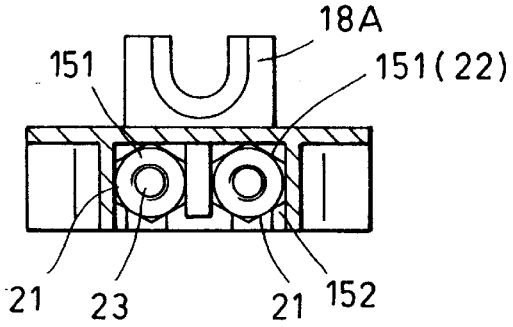
FIG. 6 is a top plan view of hexagon nuts positioned in parallel grooves of the terminal block of the present invention.

Two parallel grooves 15 each extends vertically beneath each of the spaces 12 and has a contacting corner 151 at the inner end of the groove, as shown in FIG. 6. The groove 15 has parallel side walls 152 for tightly engaging the two opposite parallel sides 21 of the hexagon nut 20 with the contacting corner 151 stopping one of the two diametrically opposite corners 22 of the nut 20. A further narrowed recess extends vertically beneath each groove 15.

The body 10 further has at the front surface a slot 121 at same horizontal level as the left and right inverted-U-shaped notches 13. The upper portion of the body 10 is provided with a positioning stud 121 projecting from the front surface and a complimentary positioning hole 17A at the rear surface, facilitating the positioning of two terminal blocks stacked in back to front manner. The lower portion of the body 10 is further provided with an engaging groove 18 at the front surface and a complimentary engaging projection 18A at the rear surface of the body, which arrangement facilitates the positioning of the lower portion of the body 10 of the stacked terminal blocks. The body 10 also includes an integrally formed base 10A for mounting on a rack (not shown), which is known in the art and will not be described herein.

The hexagon nut 20 comprises pairs of opposite parallel sides 21 and diametrically opposite corners 22 with the distance between two opposite parallel sides 21 shorter than that between the two diametrically opposite corners 22. The nut 20 also has a center threaded through hole 23. The nut 20 may be positioned in the groove 15 with one pair of opposite parallel sides 21 firmly engaged by the parallel side walls 152 of the groove 15 and one of the corners 22 received by the contacting corner 151 of the groove 15.

The L-shaped electrically conductive member 30 is formed from a strip of copper having good electric conductivity and comprises a top horizontal plate 31 and a stopper wall 32 extending from and perpendicular to the horizontal plate 31. The horizontal plate 31 has circular through holes 33 corresponding to the threaded holes 23 of the two hexagon nuts 20, respectively. The conductive member 30 is positioned in the body 10 by inserting the horizontal plate 31 horizontally into the horizontal slot 121 of the body 10, with the conductive member 30 pressing the hexagon nuts 20 and the stopper wall 32 abutting the front surface of the body 10. The stopper wall 32 thus may serve as means accessible to a user for retracting the conductive member 30 for replacement.

The clamping member 40 is a square metal plate formed by stamping and has a threaded through hole 41 at its center. The clamping member 40 has the same width dimension as that of the horizontal plate 31 of the conductive member 30 so as to overlie the through hole 33 of the conductive member 30.

Figure 9:
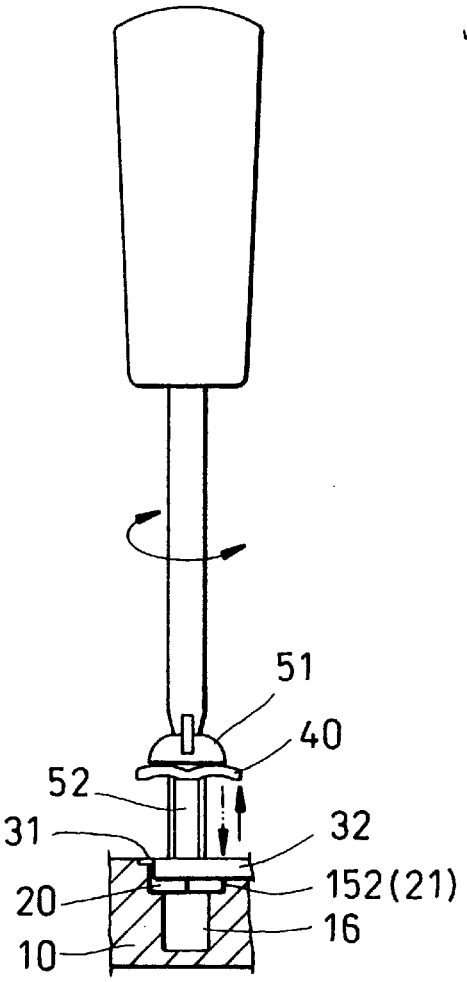
FIG. 9 is a cross sectional view of the terminal block of the present invention being operated to clamp a conductive wire therein.

The fixing screw 50 has a head 51 capable of being driven by a tool and a threaded shank 52. The head 51 has a diameter smaller than the internal diameter of the through hole 141 of the body 10, for allowing the screw 50 to extend freely through the hole 141. The threaded shank 52 is threadly engageable with the threaded hole 41 of the clamping member 40 and the threaded hole 23 of the hexagon nut 20, such that the screw 50 may be threaded through the clamping member 40 and the nut 20 to cause the clamping member 40 to press the L-shaped conductive member 30, as shown in FIG. 9.

Figure 7:
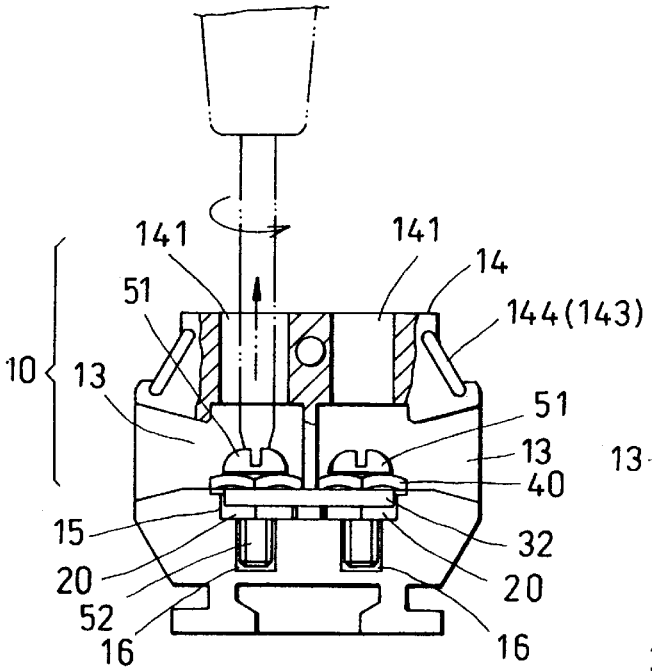
FIG. 7 is a cross sectional view of the terminal block of the present invention during assembly operation.
Figure 8:
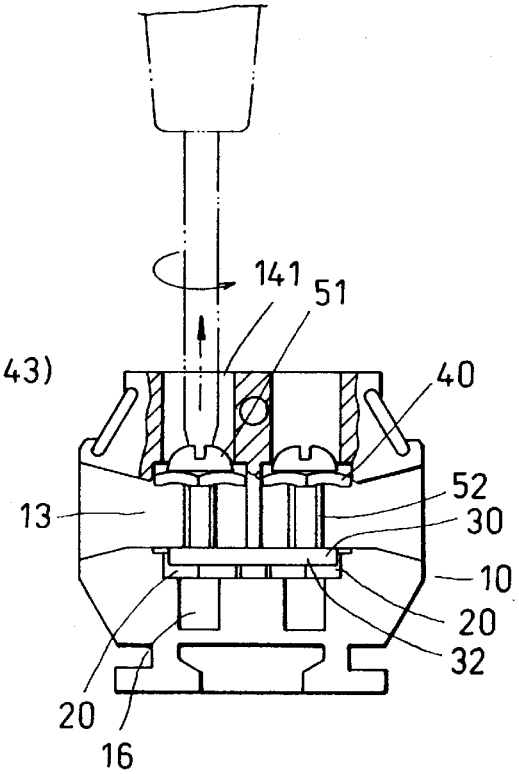
FIG. 8 is a cross sectional view of the assembled terminal block of the present invention ready for shipment.

The assembly operation of the terminal block of the present invention will be described. Referring to FIG. 5, the L-shaped conductive member 30, two clamping member 40 and two hexagon nuts 20 are firstly stacked and then threaded together by the fixing screws 50 to form a component set 70. Referring to FIG. 7, the component set 70 is then placed in the space 12 of the body 10 by inserting the horizontal plate 31 of the conductive member 30 into the horizontal slot 121 of the body 10, with the opposite parallel sides 21 of the hexagon nut 20 engaged with the side walls of the groove 15. A screw driver (shown in phantom line in FIG. 7) extending through the hole 141 of the body 10 engages the head 51 of the fixing screw 50 and rotates in counterclockwise direction, causing the screw 50 to move upwardly until the head 51 has entered in the hole 141 while the remaining parts of the component set 70 are stopped, as shown in FIG. 8. The thus assembled terminal block of the present invention prevents the components therein from falling off during the shipment period prior to reaching an end user.

Figure 11:
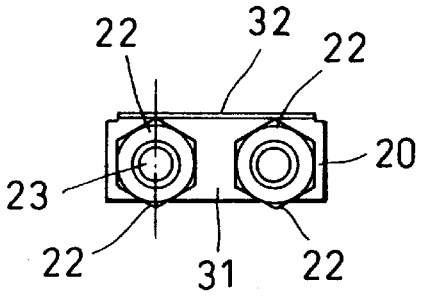
FIG. 11 is a top plan view of a combination of a conductive member and hexagon nuts of the present invention.

To use the terminal block of the present invention wherein the fixing screws 50 have been positioned at their upper limit as shown in FIG. 8 and separated from the L-shaped conductive member 30, it is convenient and time-saving for the user to let a conductive wires 60 transversely enter in the space 12 from the inverted-U-shaped notch 13. Subsequently, as shown in FIG. 9, the user drives the fixing screw 50 by a screw driver to quickly lower the clamping member 40 while the hexagon nut 20 is firmly engaged by the parallel side walls 152 of the groove 15. The conductive wire 60 is then clamped between the clamping member 40 and the horizontal plate 31 of the conductive member 30. Beneath the horizontal plate 31, the hexagon nuts 20 having the diametrically opposite corners 22 positioned as shown in FIG. 11 provides optimum stable support arrangement.

Figure 10:
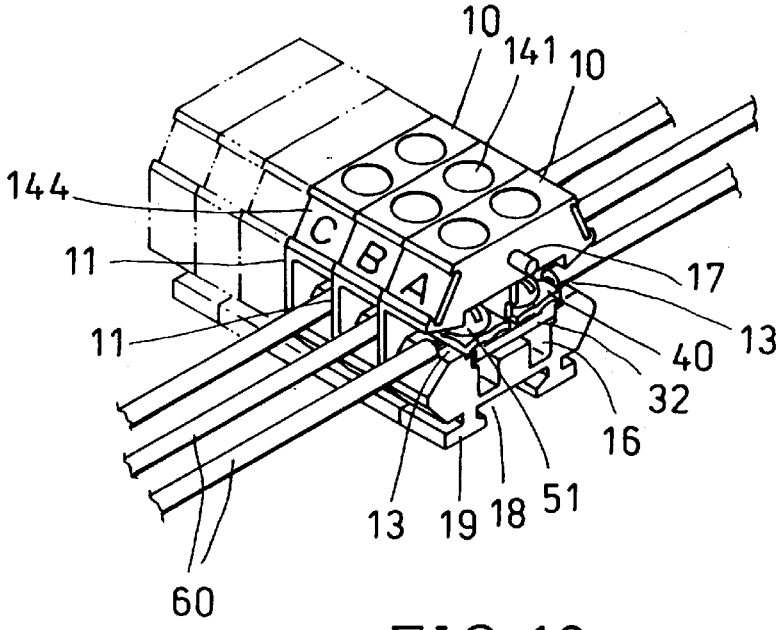
FIG. 10 is a cross sectional view of a plurality of stacked terminal blocks of the present invention.

Besides, the provision of complimentary positioning stud 17 and positioning hole 17A and complimentary engaging projection 18A and engaging groove 18 allows the terminal blocks to be firmly stacked together in a front to back manner, as shown in FIG. 10. In this regard, the inverted-U-shaped notch 13 and the terminated end of the conductive wire 60 may be shielded by the stopper surface 11 of an adjacent terminal block to achieve safety effect. And, the insert-receiving groove 143 on each slanted corner of the body 10 receive an insert 144 with layout symbol, providing identification effect.

The advantages of the terminal block of the present invention include:

1. The components of the terminal block product may be prevented from falling off during shipment and thus the integrity of the terminal block may be ensured;
2. The terminal block of the present invention provides far more easy and simple operation than prior art product because a user needs only directly to tighten the fixing screws without firstly loosening the fixing screws as required in the prior art terminal block product;
3. The provision of the inverted-U-shaped notches 13 and shielding portion 14 enables both the safety and convenience for the wire interconnecting operation; it is more quick to transversely place a conductive wire in the terminal block of the present invention than to insert a conductive wire axially into a prior art terminal block through a lateral hole;
4. The insert 144 mounted on the insert-receiving groove 143 of the present invention provides identification effect function, facilitating wire interconnectio;
5. The terminal block of the present invention has simplified components with less production cost than prior art terminal block; and
6. The conductive wire 60 is firmly clamped between the conductive member 30 and the clamping member 40 through the combination of fixing screw and hexagon nuts 20 and therefore is safe, and the clamping member will not open as that occurs in the prior art terminal block.

Figure 12:
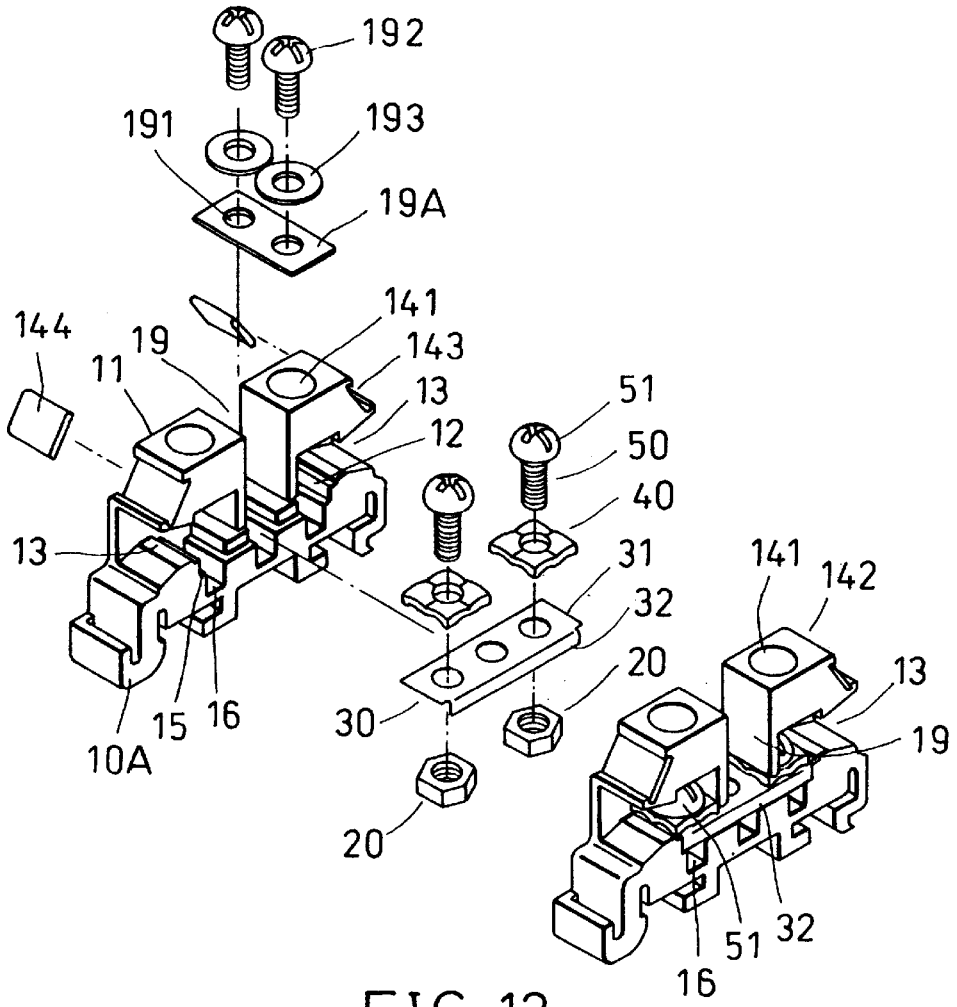
FIG. 12 is an exploded view of another embodiment of a terminal block of the present invention.
Figure 13:
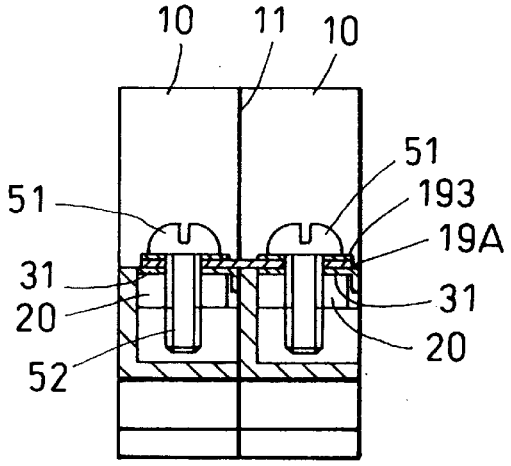
FIG. 13 is a cross sectional view of the clamping member of the terminal block of FIG. 2 in parallel circuit mode.

FIGS. 12–13 illustrate another embodiment of the terminal block of the present invention which is adapted for parallel connection of electrically conductive wires. As shown in FIG. 12, a body 10 of this embodiment of the terminal block further includes a spacing channel 19 of predetermined depth at the middle area on the upper portion of the body 10. An L-shaped conductive member 30 has an additional through hole 33 at its middle portion. A hexagon nut 20 is further provided beneath the conductive member 30. In this embodiment, there is also provided a connecting plate 19A made of electrically conductive metal material and having through holes 191 in association with washers 193 and fixing screws 192. The connecting plate 19A is intended to be placed and locked on the horizontal plates 31 of two L-shaped conductive members 30 in two adjacent stacked terminal block bodies 10 in a manner that the connecting plate 19A is perpendicular to the two conductive members 30, as shown in FIG. 13, such that the parallel connection of the conductive wires may be obtained safely without routing the conductive wires around the bodies 10.

What is claimed is:

1. An improved terminal block comprising a plastic injection-molded body including a rear surface as a stopper surface; a front surface; two spaced longitudinal parallel spaces at the front surface; two inverted-U-shaped notches at the front surface on left and right sides of the body for easily positioning an electrically conductive wire thereon; a shielding portion extending transversely above the spaces and having through holes in registration with the spaces, respectively, and slanted left and right corners each provided with an insert-receiving groove for receiving a predetermined length of an insert for identification purpose; two nut-receiving grooves parallel to each other and each extending vertically beneath one of the spaces; a narrowed recess extending vertically beneath each nut-receiving groove, each nut-receiving groove being able to slidably engage two opposite sides of a hexagon nut with a line passing along two diametrically opposite corners of the nut being parallel to the center line of the nut-receiving groove; the inverted-U-shaped notches receiving an L-shaped electrically conductive member in a horizontal position, the conductive member having a top portion and a stopper wall extending from and perpendicular to the top portion, the top portion having through holes corresponding to the two hexagon nuts, respectively; two clamping members disposed on the top portion of the conductive member and having threaded through hole; two fixing screws each having a head of a diameter smaller than that of the through hole of the shielding portion such that the fixing screw may be threaded through the clamping member, the conductive member and the hexagon nut; whereby the terminal block can be prevented from losing its components during shipment, and may provide quick, easy and safe operation of interconnecting wires when in use.

2. The improved terminal block of claim 1 wherein an engaging member is projected horizontally from the rear surface of the body at lower portion thereof, and a complimentary engaging groove is provided in the front surface of the body, thereby allowing two terminal blocks to be stacked together in a front to rear manner.

3. The improved terminal block of claim 1 wherein the body has at least a positioning hole at the rear surface of the body on the upper portion thereof and a complimentary positioning stud at the front surface of the body.

4. The improved terminal block of claim 1 wherein the shielding portion has a spacing channel at middle area for longitudinally receiving an electrically conductive connecting plate for perpendicularly mounting on two stacked terminal blocks to provide parallel circuit connection.

* * * * *